US011339586B2

(12) United States Patent
Ibañez Roig et al.

(10) Patent No.: US 11,339,586 B2
(45) Date of Patent: May 24, 2022

(54) LOCK DEVICE

(71) Applicant: MONTAJES ELECTRONICOS DORCAS, S.L., Siete Aguas (ES)

(72) Inventors: Pablo Ibañez Roig, Valencia (ES); Juan Gonzalez Sisternas, Requena (ES)

(73) Assignee: MONTAJES ELECTRONICOS DORCAS, S.L, Siete Aguas (ES)

( * ) Notice: Subject to any disclaimer, the term of this patent is extended or adjusted under 35 U.S.C. 154(b) by 218 days.

(21) Appl. No.: 16/538,600

(22) Filed: Aug. 12, 2019

(65) Prior Publication Data

US 2020/0048930 A1 Feb. 13, 2020

(30) Foreign Application Priority Data

Aug. 13, 2018 (EP) ..... 18382608

(51) Int. Cl.
*E05B 17/00* (2006.01)
*E05B 47/00* (2006.01)
(Continued)

(52) U.S. Cl.
CPC ..... *E05B 17/0029* (2013.01); *E05B 47/0001* (2013.01); *E05B 51/02* (2013.01); *E05B 2015/0431* (2013.01)

(58) Field of Classification Search
CPC ..... Y10T 292/699; E05B 17/0029; E05B 47/0001; E05B 51/02; E05B 2015/0431
(Continued)

(56) References Cited

U.S. PATENT DOCUMENTS 538,127 A * 4/1895 Schneider ..... E05B 47/0047 292/341.16
3,751,086 A * 8/1973 Geringer ..... E05B 47/026 292/144
(Continued)

FOREIGN PATENT DOCUMENTS

AU 3418768 A 9/1969
DE 880426 C 6/1953
(Continued)

OTHER PUBLICATIONS

European Search Report for Application No. EP18382608, dated Feb. 19, 2019 in 10 pages.

*Primary Examiner* — Kristina R Fulton
*Assistant Examiner* — Steven A Tullia
(74) *Attorney, Agent, or Firm* — Knobbe, Martens, Olson & Bear, LLP

(57) ABSTRACT

Lock device (1) which incorporates a closure assembly (2) that can move between an open position and a closed position, a locking device to lock said closure assembly (2) in the closed position, a first actuator (3, 31) and a second actuator (4, 41), both the first actuator (3, 31) and the second actuator (4, 41) having a locked position, in which a locking or retention action is applied, and an unlocked position, both the first and the second actuators having respective control devices which allow orders to be given to change the position of each respective actuator, wherein the first actuator and the second actuator are arranged in such a way that unlocking the locking device requires that both control devices place their respective actuator in the unlocked position.

8 Claims, 19 Drawing Sheets

(51) Int. Cl.
*E05B 51/02* (2006.01)
*E05B 15/04* (2006.01)

(58) Field of Classification Search
USPC ..... 292/92–94, 341.15, 341.16, 341.17; 70/277, 278.1–278.3, 278.7, 279.1, 70/280–282, 283.1
See application file for complete search history.

(56) References Cited

U.S. PATENT DOCUMENTS 3,893,723 A * 7/1975 Boule ..... E05B 47/0002 292/140
4,211,443 A * 7/1980 Butts ..... E05B 47/0047 292/341.16
4,302,039 A * 11/1981 Dukel ..... E05B 47/0046 292/341.16
4,616,865 A * 10/1986 Mackie ..... E05B 47/0047 292/341.16
4,824,151 A * 4/1989 Taylor ..... E05B 47/0002 292/153
4,838,591 A * 6/1989 Fuss ..... E05B 47/0047 292/341.16
4,896,909 A * 1/1990 Mauer ..... E05B 47/0047 292/341.16
4,984,835 A * 1/1991 Vadacchino ..... E05B 47/0047 292/144
4,986,099 A * 1/1991 Johnson ..... E05B 47/0012 292/144
4,986,584 A * 1/1991 Logas ..... E05B 47/0047 292/201
5,195,792 A * 3/1993 Stendal ..... E05B 47/0047 292/341.16
5,490,699 A * 2/1996 Uyeda ..... E05B 47/0047 292/201
5,788,295 A * 8/1998 Fuss ..... E05B 47/0047 292/341.16
5,924,750 A * 7/1999 Fuss ..... E05B 47/0047 292/201
5,988,711 A * 11/1999 Toma ..... E05B 47/0047 292/201
6,076,870 A * 6/2000 Frolov ..... E05B 47/0047 292/144
6,325,429 B1 * 12/2001 Oxley ..... E05B 47/0047 292/341.16
6,390,520 B1 * 5/2002 Holzer ..... E05B 47/0046 292/341.16
6,966,585 B2 * 11/2005 Egi ..... E05B 47/0047 292/144
7,438,335 B1 * 10/2008 Uyeda ..... E05B 47/0046 292/341.15
7,472,934 B2 * 1/2009 Burke ..... E05B 47/0047 292/341.16
7,562,918 B2 * 7/2009 Toma ..... E05B 47/0047 292/340
8,096,594 B2 * 1/2012 Uyeda ..... E05B 47/0046 292/341.15
8,454,063 B2 * 6/2013 David ..... E05B 47/0046 292/341.16
8,720,959 B2 * 5/2014 Wittke ..... E05B 47/0047 292/341.15
8,833,814 B2 * 9/2014 Chang ..... E05B 47/0047 292/341.16
9,121,198 B2 * 9/2015 Gresser ..... E05B 47/0047
9,617,755 B2 * 4/2017 Peabody ..... E05B 15/022
2003/0127869 A1 * 7/2003 Herron ..... E05B 47/0047 292/341.16
2004/0061343 A1 * 4/2004 Bashford ..... E05B 47/0047 292/341.16
2010/0289279 A1 * 11/2010 Toma ..... E05B 47/0047 292/341.16
2011/0181060 A1 * 7/2011 Geringer ..... E05B 47/0047 292/341.16
2011/0241361 A1 * 10/2011 Orbeta ..... E05B 15/0093 292/341.16
2017/0342742 A1 * 11/2017 Snodgrass ..... E05B 17/2011
2018/0044945 A1 * 2/2018 Geringer ..... E05B 65/1093

FOREIGN PATENT DOCUMENTS

DE 3942379 A1 * 7/1990 ..... E05B 47/0047
DE 10347528 B3 3/2005
DE 102007031483 A1 10/2008
DE 202010010895 U1 10/2010
DE 102014104020 A1 * 9/2015 ..... E05B 15/0205
DE 102017202376 B3 11/2017
EP 1788169 A1 5/2007
EP 2527570 A2 11/2012
EP 2662515 B1 2/2018
GB 2251024 A * 6/1992 ..... E05B 47/0047
WO WO-8800633 A1 * 1/1988 ..... E05B 47/0046
WO 03/087503 A1 10/2003
WO 2006/088781 A2 8/2006
WO WO-2014019088 A1 * 2/2014 ..... E06B 1/52

* cited by examiner

LOCK DEVICE

CROSS-REFERENCE TO RELATED APPLICATION

This application claims priority to European Patent Application No. 18382608.0 filed on Aug. 13, 2018, the disclosure of which including the specification, the drawings, and the claims is hereby incorporated by reference in its entirety.

FIELD OF THE INVENTION

The present invention relates to a lock device. More particularly, the present invention relates to a novel arrangement which has numerous advantages, including improving the operation of security locks or anti-panic locks, preferably in a small-size format, with regard to load situations, although this is only one of many advantages.

The present invention may be applied to a wide range of lock devices, for example electric door openers, security doors, evacuation route doors and anti-panic doors, although the invention is not necessarily limited to said applications.

BACKGROUND OF THE INVENTION

Conventionally, door-opening devices have a single actuator (usually a coil) responsible for moving the device from the locked position (in which opening is not possible) to an unlocked position (in which opening is possible).

Conventionally a coil has been used in order to encompass preloaded opening and locking at the same time, acting on the bolt directly or indirectly by means of a set of bars, plates, shafts, bearings, etc. Conventionally in so-called door openers, the action of the coil is applied to a rotating locking lever, which in turn retains a rotating 'long bar', which in its turn retains the bolt.

In said devices a single element must easily release the system when a particular force (preload) is applied thereto and, at the same time, said element must lock said system when a great deal of pressure is applied. To achieve release where there is a large amount of preload a solution must be sought in which the system is easily released, and to lock said system a solution must be sought in which there is maximum interlocking to ensure there is no release.

In this situation, with the passage of time, the parts wear owing to the abrasion produced when preloaded opening occurs; this wear favours opening while compromising the locking function, and therefore it could indicate that in the long term the system is inefficient.

Moreover, there are generally two types of operation for lock devices, a normal 'fail secure' operation and a reverse 'fail safe' operation.

Normal operation may operate with both direct current and alternating current; when current is supplied to the coil of the mechanism said mechanism unlocks the system and allows opening.

Mechanisms that use the reverse operation always operate with direct current and are permanently supplied with electricity to keep the door closed; once the electricity supply is cut, said mechanisms allow opening.

Furthermore, electric door openers or automatic entry phone systems, such as those disclosed in documents EP2527570A and US2010/0289279, are based on a locking mechanism which unlocks a lever situated in a closed position by hitting a tripping pin, which is moved by an electromagnetic field created by electrical excitation, generated by a selectively actuated coil. These door openers therefore comprise a single actuator having a coil and a mechanism which changes position depending on the electrical supply of the coil. The mechanism comprises a so-called rotating 'long bar' and another, also rotating 'short bar' or 'locking lever', which receives an action from the coil and locks the long bar. Once unlocked the long bar allows the rotation of the bolt on which the latch or strike plate of the door come to a stop, allowing said door to open.

Document EP2662515B1 discloses a door opener having a single actuator and a single coil, wherein the tripping pin performs two actions during its travel. First it causes an element protecting an actuation pin of the short bar to descend. After overcoming this obstacle, the tripping pin makes contact with the actuation pin, which automatically moves the short bar, leaving the system in the unlocked position.

Furthermore, the door openers are installed in different positions since an apparatus can be used for doors that open to the left and also, by being rotated through 180°, for doors that open to the right.

Since the system works using a tripping pin which is moved to the closed or open position by a very sensitive spring, and because the system is unidirectional, the mechanism functions better or worse depending on the position thereof in the installation. This difference arises because the force of gravity favours the movement of the tripping pin in one direction or works against the movement thereof when the mechanism is rotated through 180°. This difference cannot be absorbed by the spring, since the most sensitive spring possible must be used for correct operation and minimum electricity consumption.

WO03/087503 discloses an electrically actuated lock device which comprises a bolt or closure member and a bar which locks the bolt. The locking bar is actuated electrically to release a mechanism which locks the bolt-locking bar.

Document DE102007031483A1 discloses a door opener according to the preamble of claim 1, which has two separate, independent actuators which act on a single locking mechanism. The actuators are arranged serially: actuation of either of the two actuators unlocks the device, regardless of whether or not the other actuator has been actuated.

SUMMARY OF THE INVENTION

An object of the present invention is to disclose a versatile device which provides for preloaded door openers which are secure against unauthorised opening but which provide a solution to the problem of achieving a compromise between a closure function with preloaded opening and secure locking or interlocking. The invention and the preferred embodiments thereof also have other advantages which will be cited below or which can be deduced from the following explanations.

More specifically, the present invention discloses, according to a first aspect, a lock device which incorporates a closure assembly that can move between an open position and a closed position, a locking device to lock said closure assembly in the closed position, a first actuator and a second actuator, both the first actuator and the second actuator having a locked position, in which they apply a locking or retention action, and an unlocked position, both the first and the second actuators having respective control devices which allow an order to be given to change the position of each respective actuator, characterised in that the first actuator and the second actuator are arranged in such a way that unlocking the locking device requires that both control devices place their respective actuator in the unlocked position. Control devices may include a user electric supply or an access control regulated in the mechanism or electronically (such as a capacitor, for example).

Preferably, at least one of the two actuators can be actuated selectively. More preferably, both actuators are actuated selectively.

In a particularly preferable manner, each actuator is capable of giving orders independently and separately from one another. Still more preferably, the actuators are arranged in such a way that unlocking the locking device requires that said control devices independently position the respective actuator in the locked position.

Still more preferably, the first actuator applies a retention position in the locking function and the second actuator applies an interlocking action in the locked position.

Also preferably, if an opening attempt is made, the locking action of the actuators is coordinated and/or sequential.

In a particularly preferable way, if an opening attempt is made, the actuators are arranged in such a way that the actuator that applies a retention action acts before the actuator that applies an interlocking action.

The present invention proposes devices which divide the retention action up to preloaded opening and the secure locking action between two actuators which preferably act sequentially. A first actuator system may be responsible for preloaded opening; if while the system is in the locked position the preload value is exceeded, another system responsible for secure locking comes into play and locks the opening movement. If there is no load or said load is low enough not to exceed the limit, in order to open, the locking system must be released first and then the preload system.

Separating both actions using two actuators that can be selected and are independent of one another allows the system to be optimised and maximum performance to be obtained for each action instead of seeking an intermediate point of compromise between the two actions, as happens at present. The invention also allows types of energy supply to be separated, and actuators having different types of energy supply may be combined, making it possible to produce the combinations that clients require, such as implementing a pneumatic actuator, an electromagnetic actuator for alternating current, a motorised actuator, a hydraulic actuator, etc., with another actuator, for example an electromagnetic actuator for direct current, or any other type of actuator.

The system is preferably sequential since, if it is not (as in the case of 'fail secure' productions) and energy is supplied to unlock the door opener, the actuator with the secure locking characteristic (for example, the second actuator) might not have been unlocked when the actuator with the preload characteristic (for example the first actuator) had already been released.

The lock device according to this first aspect of the invention provides that said sequential nature may be obtained using different means: by the action of an electronic system for the control thereof, by the way the system is operated (the locking system carries out a short movement and the preload system carries out a long movement), by forced mechanical control (for example, if A does not operate then B cannot operate), by a progressive actuation system (supplying both systems at the same time but gradually so that, depending on the characteristics of each system, one system may be actuated before the other), etc.

An additional advantage of the device according to the first aspect of the present invention may involve each actuator having operating directions that differ from one another. In preferred embodiments, said operating directions may be counter to one another. Thus, an external action that tends to unlock one of the actuators (such as a shake, vibration, etc.) also tends to lock the other actuator, which makes the mechanism more secure in the event of accidental openings or malicious forced attempts using repeated shakes.

Moreover, since two operating directions may be available for each actuator, said actuators can be positioned in such a way that, while one deteriorates owing to the force of gravity, the other can be positioned so as to operate better.

Preferably, both the first and the second actuators are positioned in such a way that they apply their locking action directly on the closure assembly or on the device that is actuated by the bolt, for example a part that is pushed by the bolt in order to open the lock device. More preferably, the first actuator and the second actuator apply their locking action at different points of the closure assembly or of said device which is actuated by the closure assembly. The device which is actuated by the bolt may also comprise two or more parts actuated by the closure assembly or bolt. In this case, each actuator may apply its locking or retention action on different parts.

In an alternative embodiment, the second actuator applies its locking action directly on the first actuator.

Preferably, in the locked or closed position, it is the first actuator that applies the retention, for example said actuator applies a predetermined force which, on being overcome by an external action, allows the closure assembly to move. Preferably, said external action is applied via the closure assembly. More preferably, the first actuator applies a predetermined force to the closure assembly which, on being overcome, allows the bolt to move.

In an especially preferred manner, the second locking device has a clearance which defines limits to said movement of said part or of the closure assembly, when the second actuator is positioned in the locked position.

As indicated previously, when both actuators are in the locked position, a movement to open the closure assembly preferably causes the action of each actuator to be applied sequentially. More preferably, said movement of the closure assembly causes the retention action of the first actuator to be applied first.

Advantageously, to move from the locked position to the unlocked position, the device requires both actuators to move from the locked position to the unlocked position sequentially and independently.

According to the present invention, both the first and the second actuator are preferably actuated electrically, electromagnetically, electromechanically, pneumatically or hydraulically.

Preferably, the closure assembly comprises a through-pin or a bolt.

The functioning of particular preferred embodiments of the first aspect of the invention may address different situations.

In a first situation, an authorised opening attempt is made, both actuators initially being in the locked position. In this case, opening takes place via an order to change the state of the coils, motors, etc., which may take place in two states. In a first intermediate state, the system has opened the secondary locking system but the preload system has not opened. Then the preload system is released. Next, all the parts are positioned to allow the free rotation of the closure assembly or bolt. To produce closure the state of the coils, motors, etc. must be changed.

In a second situation, an unauthorised opening attempt is made, both actuators initially being in the retention/locked position. The unauthorised attempt may overcome the preload of the retention system, but opening will not take place because the secondary locking system is locked. If pressure ceases to be applied, the system resets the preload system which, like the locking system, has all the elements positioned for locking.

In a third situation, the preload actuator is in the closed or locked position and the secondary actuator is in the opening position. In this case, the door can be opened via an opening attempt of which the action overcomes that of the preload. Said opening may also be achieved automatically or by applying a force lower than that of the preload, if a change-of-state order is sent to the preload actuator to move to the unlocked state.

According to a second aspect, the present invention also discloses an alternative solution to prevent wear on the parts of a conventional locking (or interlocking) system. If necessary, this solution makes it possible to dispense with both actuators.

In a fourth situation, the preload actuator is in the opening position and the secondary actuator is in the closed position. In this case the door will only open if there is no preload.

More specifically, the present application also discloses a lock device which incorporates a closure assembly actuated by a bolt or through-pin during the opening movement of the device and at least one device for locking or retaining the closure assembly, in which the closure assembly comprises a part which slides along a defined, preferably linear, path. More preferably, the part slides following a rotary path of the closure assembly.

This arrangement prevents the wear that occurs in the typical arrangement of a long bar and locking or interlocking lever since the preloaded opening function is separate from the locking function, said locking function being undamaged by wear. In addition, some embodiments of the present invention may be produced exclusively with linear movements, with no rotation. This also produces a considerable saving of space, which allows the available space to be used to install a larger actuator (preferably, a coil).

This arrangement is especially advantageous when the actuator is a preloaded opening actuator, that is, one in which, if an action is performed on the device which overcomes the force generated by the actuator, this allows the opening movement. Preferably, a device is pushed by the closure control (bolt or through-pin).

To save more space, the locking or retention device preferably moves from the locked or retained position to the unlocked position via a linear movement of an element that interacts with said part. Alternatively, pivoting sliding movements are also possible.

Also preferably, said element comprises a projection matching a recess in said part, or alternatively the reverse arrangement (the element comprises a recess and the part a matching projection).

Advantageously, the projection is spherical. This arrangement is a simple and efficient way of achieving preloaded opening retention. To do this, the spherical projection may be combined with a recess which, at least in part, has a spherical cross section, said recess preferably covering less than half of the sphere of the projection.

Preferably, the element is actuated by a coil. Still more preferably, the coil acts directly on said element. A motor, a pneumatic system, etc. may be used instead of a coil.

According to a third aspect of the invention, the device may incorporate a spring adjustment system to modify the characteristics of the mechanism as required by the user.

Preferably, said adjustment can be made independently.

Also preferably, said adjustment may be made in a manual or automated manner.

More preferably, said automated adjustment may be made using motors, coils, pneumatic systems, etc.

Still more preferably, said automated adjustment may be made via means internal to the mechanism or via controls outside said mechanism.

Advantageously, said adjustment may be carried out on any elements that move during operation of the mechanism.

BRIEF DESCRIPTION OF THE DRAWINGS

For a better understanding, the accompanying drawings are an explanatory but non-limiting example of an embodiment of the lock device according to the present invention.

DETAILED DESCRIPTION OF THE PREFERRED EMBODIMENTS

Figure 1:
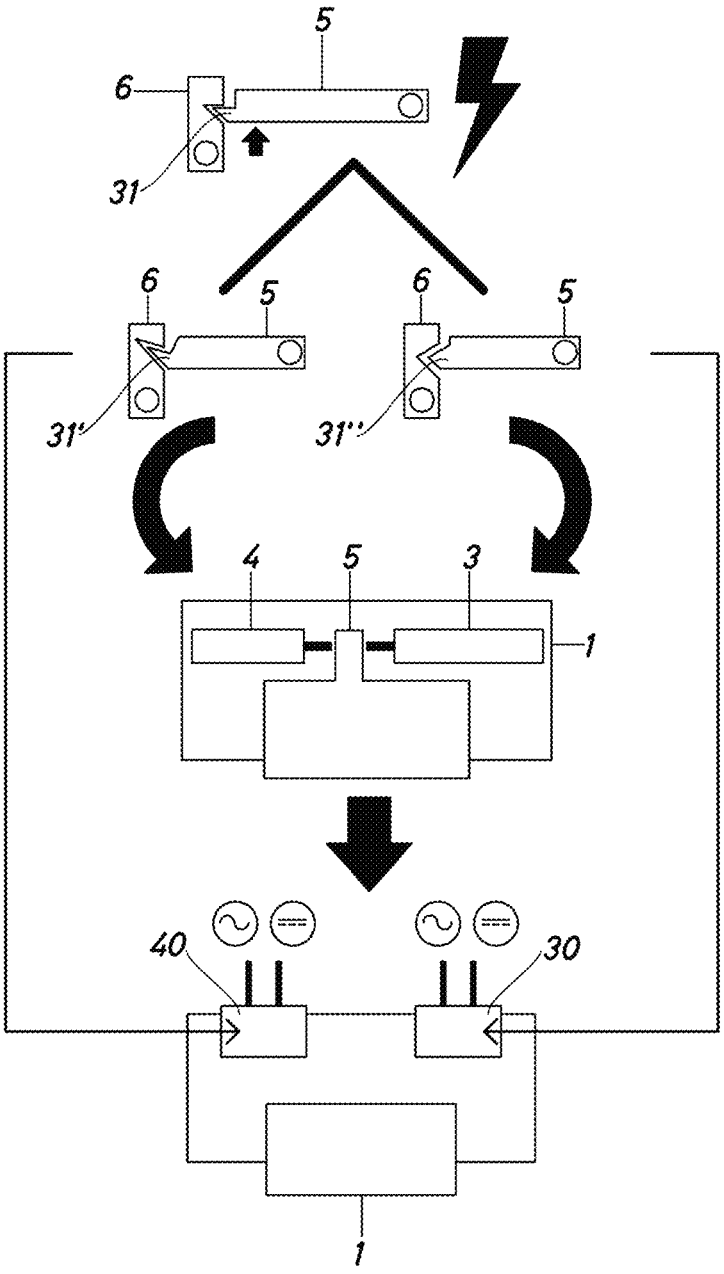
FIG. 1 shows a diagram explaining the invention.

The upper portion of FIG. 1 shows a known type of central bar or part -5-, the retention force of which must be overcome by a bolt for opening to be possible. To prevent the device from opening, the position of the central part -5- is locked by means of an actuator -6-. In some embodiments of the opening device, the actuator -6- is known as a locking lever or short bar. Locking is achieved by means of a projection, end or part -31- of the actuator which is inserted in a corresponding housing receptacle in the central part -6-, being thus interlocked. Typically, this type of device has a single actuator, the function of which, when it receives an opening order, is to unmesh the central part -5- by retracting the bar of the actuator -6-.

Depending on the shape of the part -31- and of the corresponding housing receptacle, it may be easier or more difficult to force unlocking by an action transmitted through the central part itself (for example, an unauthorised opening attempt). The second row of FIG. 1 shows an easily opened part -31"-, which applies a retention force which can be overcome if sufficient force is used, and an interlocking part -31'-which, on being interlocked, cannot be forced to come out however much pressure is applied in attempting to force the movement of the bolt. The easily opened part -31"- allows the device to open in preload situations, whereas the interlocking part -31'- provides locking with maximum security against burglary.

As shown in the third row of FIG. 1, the present invention is based on the use of two or more independent actuators, in this case designated -3-, -4-, for a single opening device having a single closure assembly. The figure shows that both actuators -3-, -4- act on the same central part at different points. It is also possible for the second actuator to act on the first actuator. In each case, each of the actuators may have an automatic actuation device -30-, -40-. In a way characteristic of the present invention, the automatic actuation devices -30-, -40- of the actuators -3-, -4- and the action thereof are independent of one another, that is, the actuation of one of the two actuators does not entail the actuation of the other actuator. The present invention also provides that, during an authorised unlocking operation, each actuator -3-, -4- preferably acts sequentially and consecutively.

FIGS. 2 to 6 show an embodiment of the present invention in a 'fail secure' configuration.

The opening device -1- comprises a locking device which, in turn, has a first and a second actuator, each having a corresponding actuation element, such as a coil -3-, -4-, for example. Each coil can be actuated independently, and therefore each coil has an independent automatic control device, although the functions of such an independent automatic control device may be performed by a single control device which has suitable energy supply circuitry to supply each coil independently, or alternatively to send independent actuation orders thereto. The control device or devices may form part of the lock device or may be external thereto. For reasons of clarity, no wiring or control device has been shown in the figures.

The locking device consists of two portions or actuators governed independently by each of the coils -3-, -4-: an interlocking or locking portion -4-, -41-, which only allows opening via an electrical supply, and another retention portion with preloaded opening -3-, -31-. Both systems have their own actuator elements -31-, -41- which, in the locked position, are inserted in respective housings receptacles -53-, -54-, situated at different points, and in this particular case at opposite points, of a central part -5-. The bolt -2- pushes the central part -5- during the opening movement thereof, which part slides following a linear path along a channel or track. Thus, if the movement of the central part -5- along its channel is impeded, the bolt -2- cannot be moved and the door or leaf element which is closed by the system cannot be opened.

As can be seen, the shape of the actuator element or locking part -41- of the locking portion and the corresponding receptacle -54- are such as to produce a limit stop which cannot be forced by the central part -5- in its normal movement, that is, along its channel or track. In contrast, the end of the actuator element of the retention portion in the example shown consists of a ball -31-. Owing to its shape, the ball -31- transmits some of the force applied by the central part -5- to the shaft which pushes said ball to occupy its receptacle -53-. Thus, if a particular preload or opening force is overcome, the retention system is released, because the ball -31- comes out of the corresponding receptacle -53-.

Figure 2:
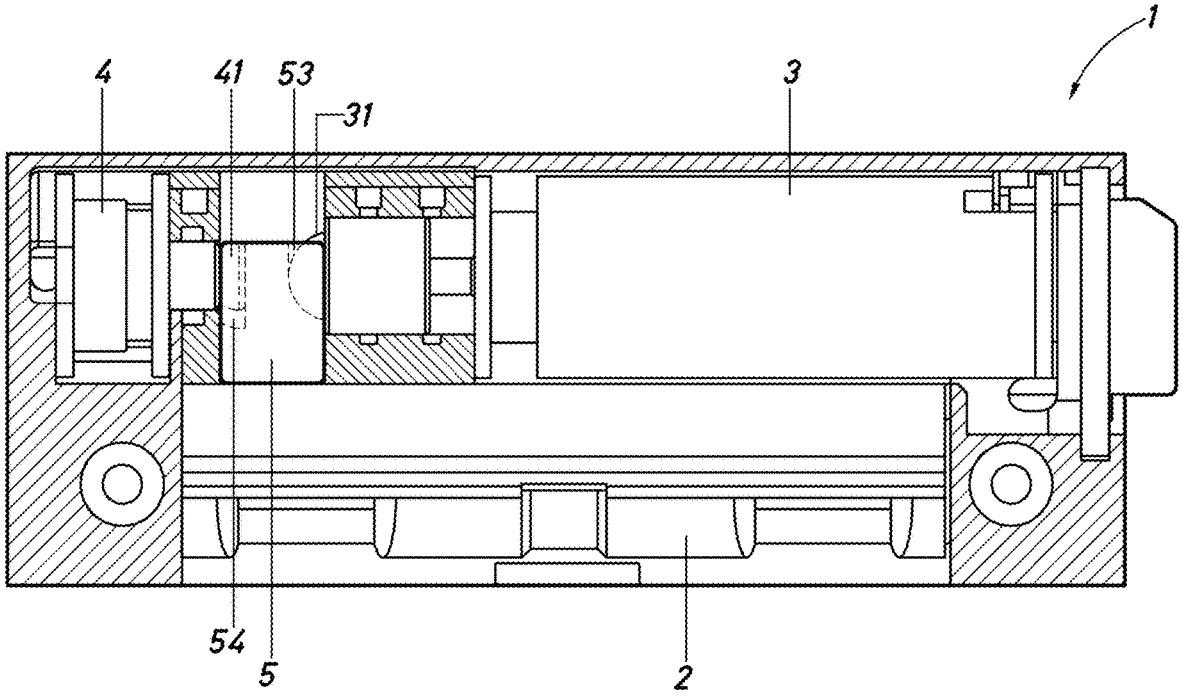
FIG. 2 shows a cross section of a first embodiment of a device according to the present invention having an electrical supply and therefore being a 'fail secure' device, in the locked position.

As can be seen in FIG. 2, the dimensions of the receptacle -54- of the locking part -41- are greater than those of the locking part, so that, in the locked position, there is a play or clearance between the central part -5- and the locking part -41-, which do not contact in the direction of movement of the central part. This play ensures that the locking part -41- will come to a stop against the central part -5- only after an interaction between the ball -31- and the central part -5-.

In the example shown, the locking part makes contact with the central part in the direction perpendicular to the direction of movement of the central part, but it may also be advantageous to also leave a play between the locking part and the central part in said direction perpendicular to the direction of movement of the central part.

In the locked position shown in FIG. 2, if an unauthorised access attempt occurs, the system of the retention portion with preloaded opening is actuated first. If the force applied overcomes the retention force of the preload system, the system of the locking portion comes into play to guarantee the integrity of the system against the access attempt.

In the example shown, the coil -3- on the right works on the preloaded opening system (a person leaning on the door, wind, pressure seals, etc.). The system is based on a mechanism which reduces the force of the bolt -2-. In this version, said mechanism comprises a ball -31- made of a very durable material, such as steel. When the central part -5- applies pressure to the ball -31-, because of its shape, the ball tends to move, freeing the movement of the central part -5-. If the coil -3- is actuated, the ball -31- is able to slide.

The coil -4- on the left acts on a locking part -41- of the system. When the coil -4- is electrically supplied, the locking part -41- moves, freeing the central part -5- and hence the system.

Figure 3:
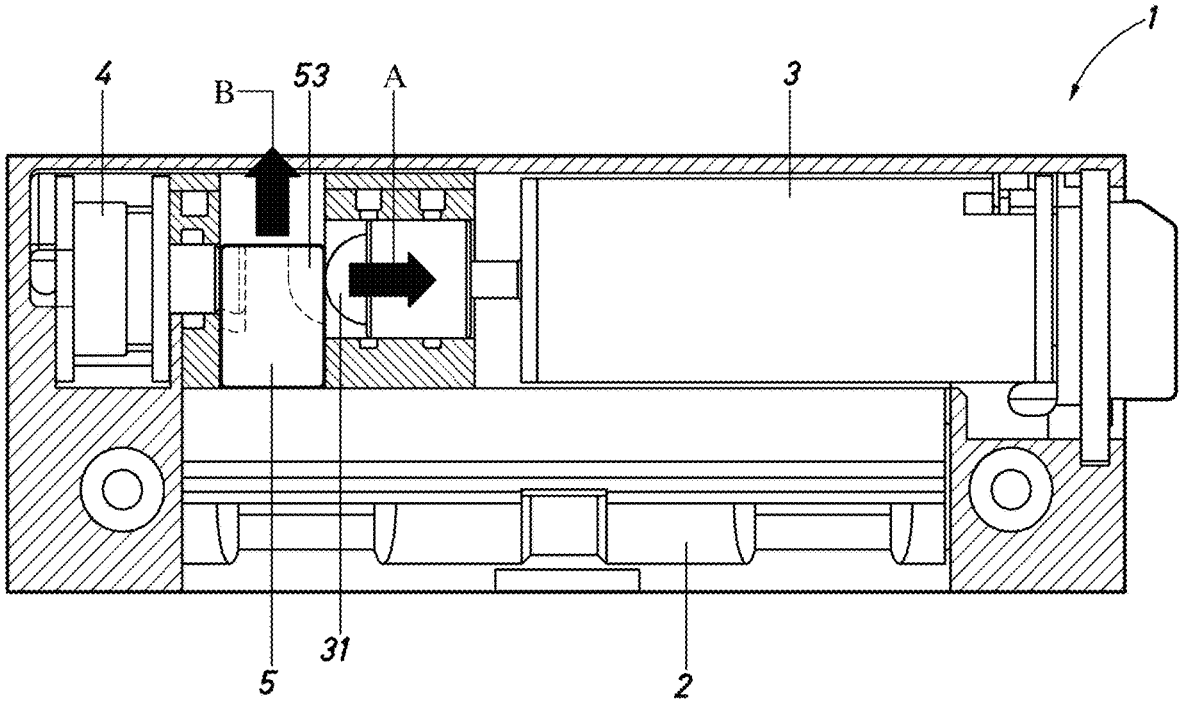
FIG. 3 shows a first embodiment in the locked position during an unauthorised access attempt.
Figure 4:
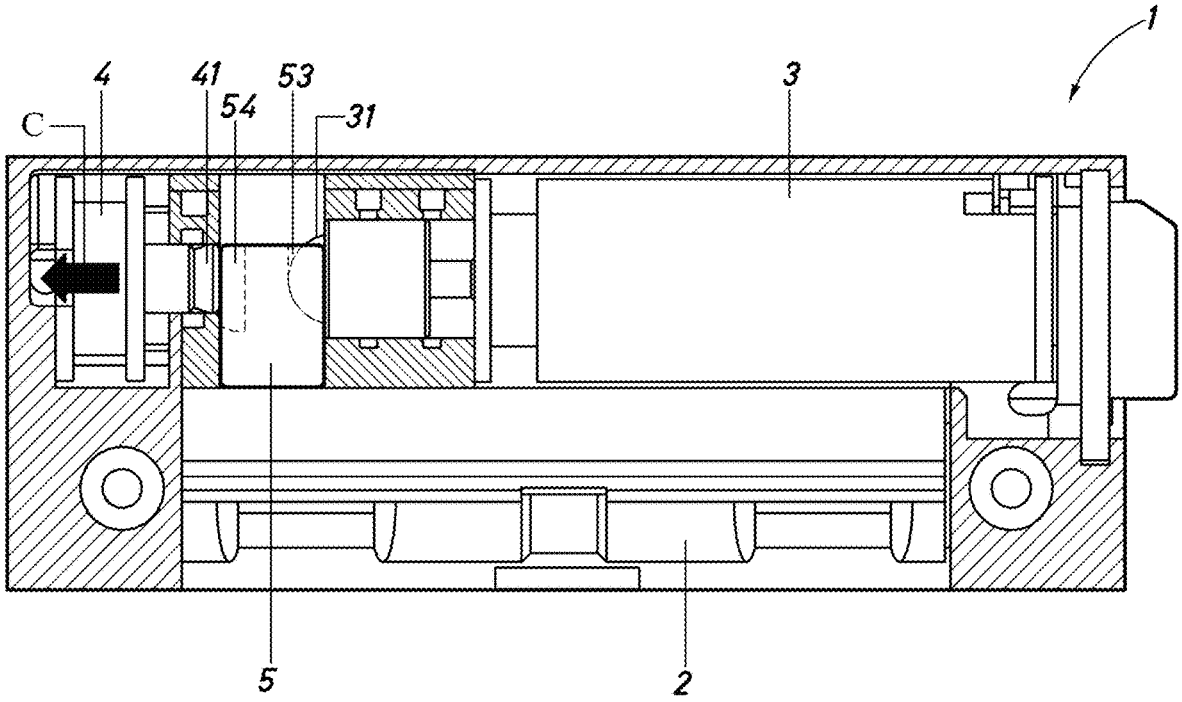
FIG. 4 shows a first phase of the process of unlocking the device of the first embodiment.
Figure 5:
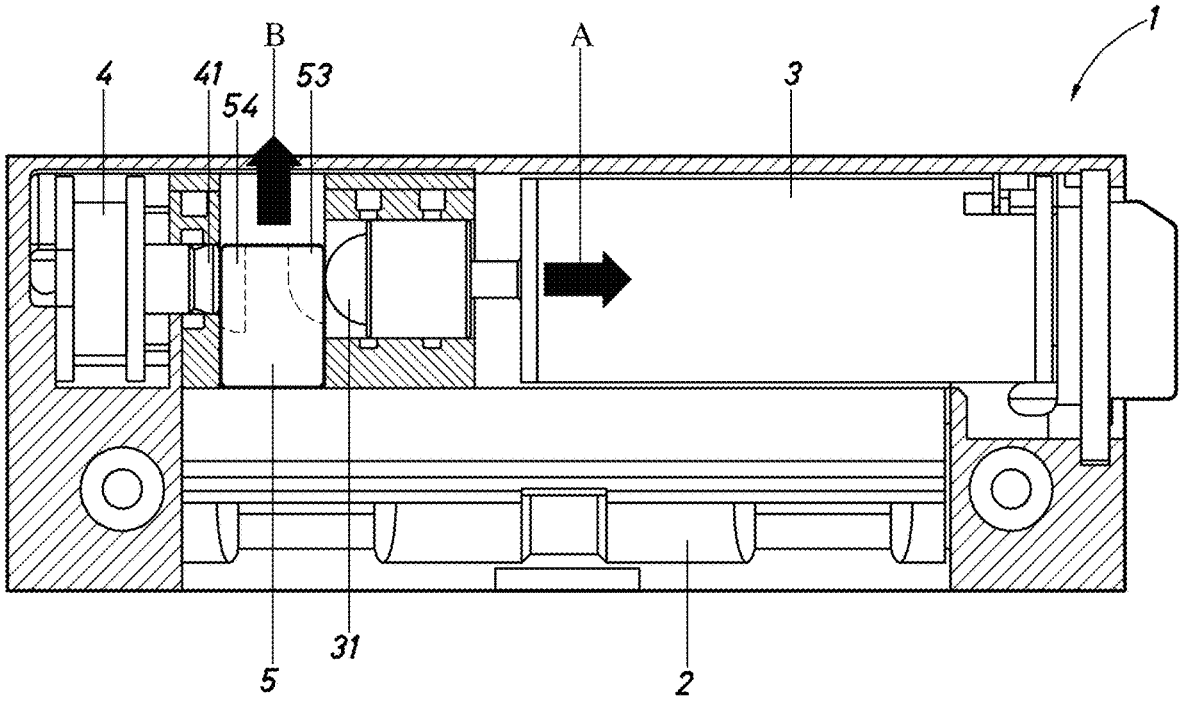
FIG. 5 shows a second phase of the process of unlocking the device of the first embodiment.

Next, the operation of the system when an unauthorised access attempt takes place will be described in relation to FIG. 3.

In said situation, the door is closed and is not electrically supplied. If there is an unauthorised access attempt, the person who is trying to enter applies force or pressure. The unauthorised action B on the system may succeed in overcoming the retention force of the ball -31- and of the element holding said ball in that position, for example, a spring in that position (the spring has not been shown). In this case, the ball moves -A- freeing the central part. At this point, the second coil -4- comes into play. Since the coil -4- is not being supplied with electricity by an authorised user, the locking part -41- remains in the locked position, the movement of the central part -5- is still impeded and therefore the movement of the bolt -2-, which keeps the door closed, is locked.

Figure 6:
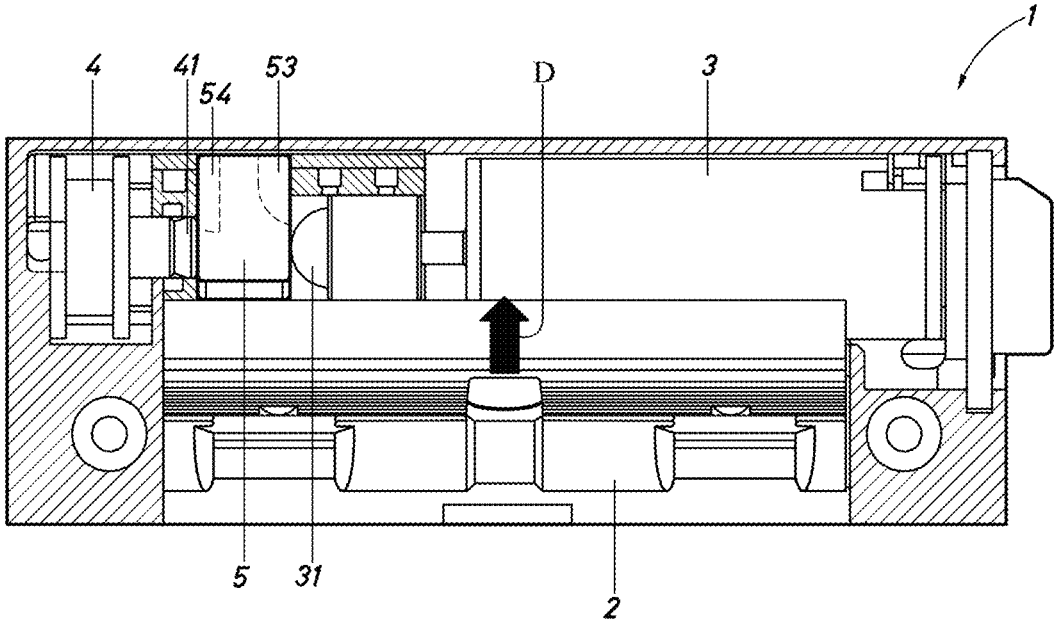
FIG. 6 shows the opening of the already unlocked first embodiment.

If, on the contrary, an authorised user wishes to open the door, the authorised opening system generates an electrical, pneumatic or other supply signal. Using suitable components, for example an internal or external control system, the system first actuates the left-hand coil -4- which retracts the locking part -41- which, by the action -C-, comes out of the housing receptacle -54- of the central part -5- and arrives at its unlocked position (see FIG. 4). Next the coil -3- of the preload portion is actuated, allowing the ball -31- to retract, said ball leaving its housing receptacle -53- in the central part -5- (see FIG. 5). As can be seen in FIG. 6, this arrangement allows the central part -5- to move and hence allows the rotation -D- of the bolt -2-.

FIGS. 7 to 12 show a second embodiment of a device according to the present invention, which has a so-called "fail safe" operation. In the figures, elements that are the same or similar to those shown in FIGS. 2 to 6 have been identified with identical reference numerals and will therefore not be described in detail.

This second embodiment also comprises two coils -3-, -4- which perform independent actions.

The device consists of two portions independently governed by each of the coils -3-, -4-: a locking portion -4-, -41-, which only permits opening by the electricity supply being cut, and another retention portion -3-, -31- with preloaded opening. Both systems have their own actuator elements which, in the locked position, are inserted in corresponding housing receptacles -53-, -54- in a central part -5-.

The device consists of two portions independently governed by each of the coils -3-, -4-: a locking portion -4-, -41-, which only permits opening by the electricity supply being cut, and another portion -3-, -31- with preloaded opening. Both systems have their own actuators -31-, -41- which, in the locked position, are inserted in corresponding housing receptacles -53-, -54- in a central part -5-. The bolt -2- pushes the central part -5- during the opening movement thereof. Thus, if the movement of the central part -5- along its channel is impeded, the bolt -2- cannot move and the door or leaf element which is closed by the system cannot be opened.

As can be seen in FIGS. 7 to 12, the shape of the locking part -41- of the locking portion is such that a limit stop is produced which cannot be forced by the central part -5- in its normal movement, that is, along its channel or track. In contrast, the actuator of the preloaded portion is a ball -31-. Because of its shape, said ball -31- transmits some of the force applied by the central part -5- to the shaft which pushes said ball so that it occupies its housing receptacle -53-. Thus, if a particular preload or opening force is overcome, the preload system is freed.

Figure 7:
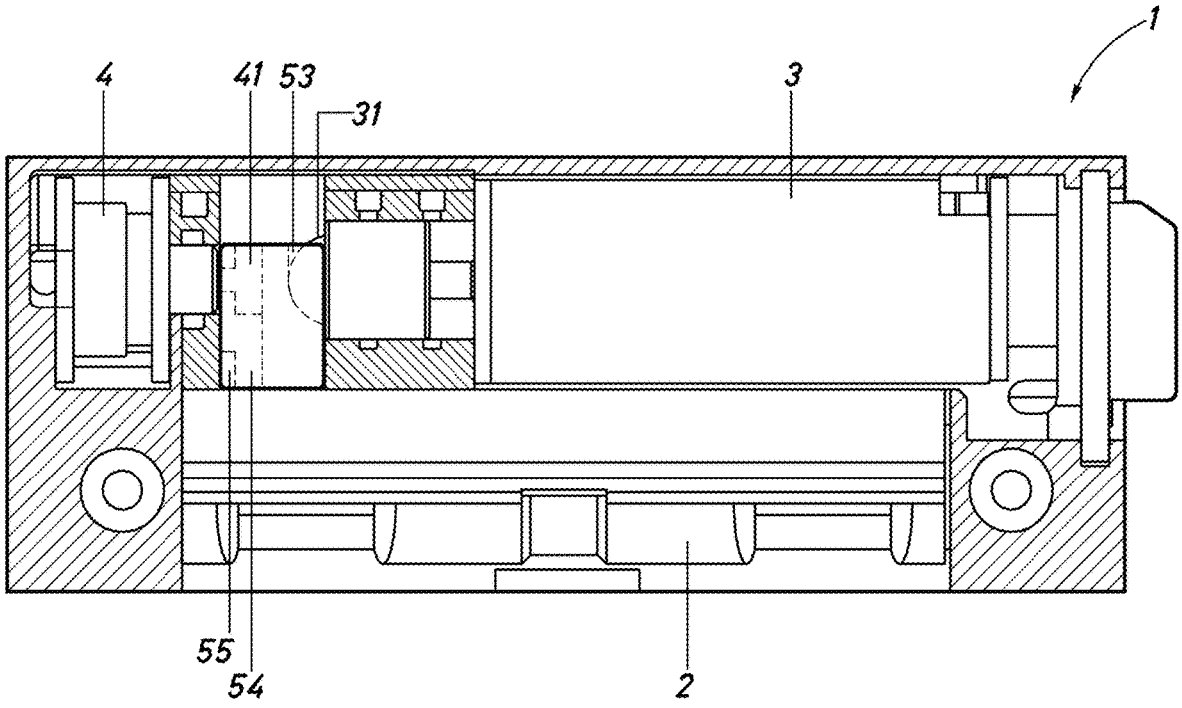
FIG. 7 is a cross section of a second 'fail safe' embodiment of a device according to the present invention having no electrical supply and therefore in the unlocked position in a system.
Figure 8:
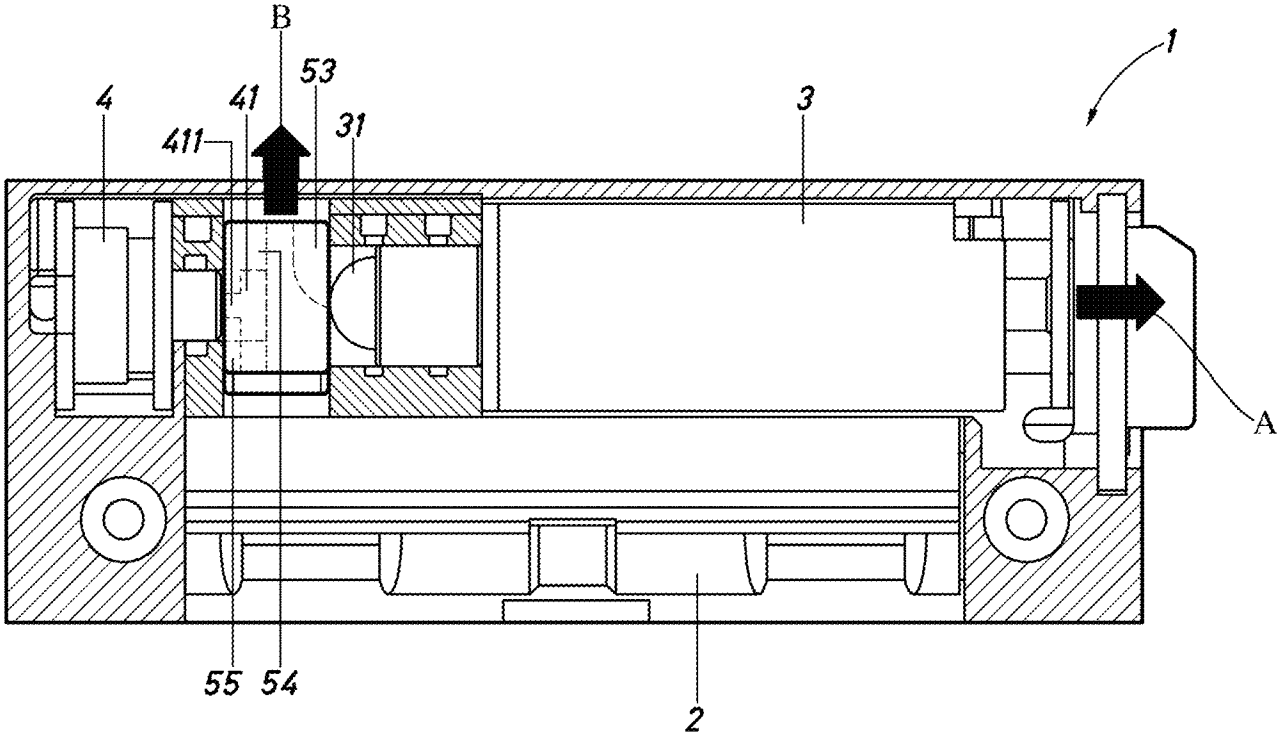
FIG. 8 shows the second embodiment showing that if there is a supply of electricity, it is possible to open the door freely so that said door stays open (security door function).

As can be seen in FIG. 7, the dimensions of the housing receptacle -54- of the locking part -41- are greater than those of the locking part so that, in the locked position, there is a play between the central part -5- and the locking part -41-, which do not contact in the direction of movement of the central part. This play ensures that the locking part -41- will come to a stop against the central part -5- only after an interaction between the ball -31- and the central part -5-.

Figure 9:
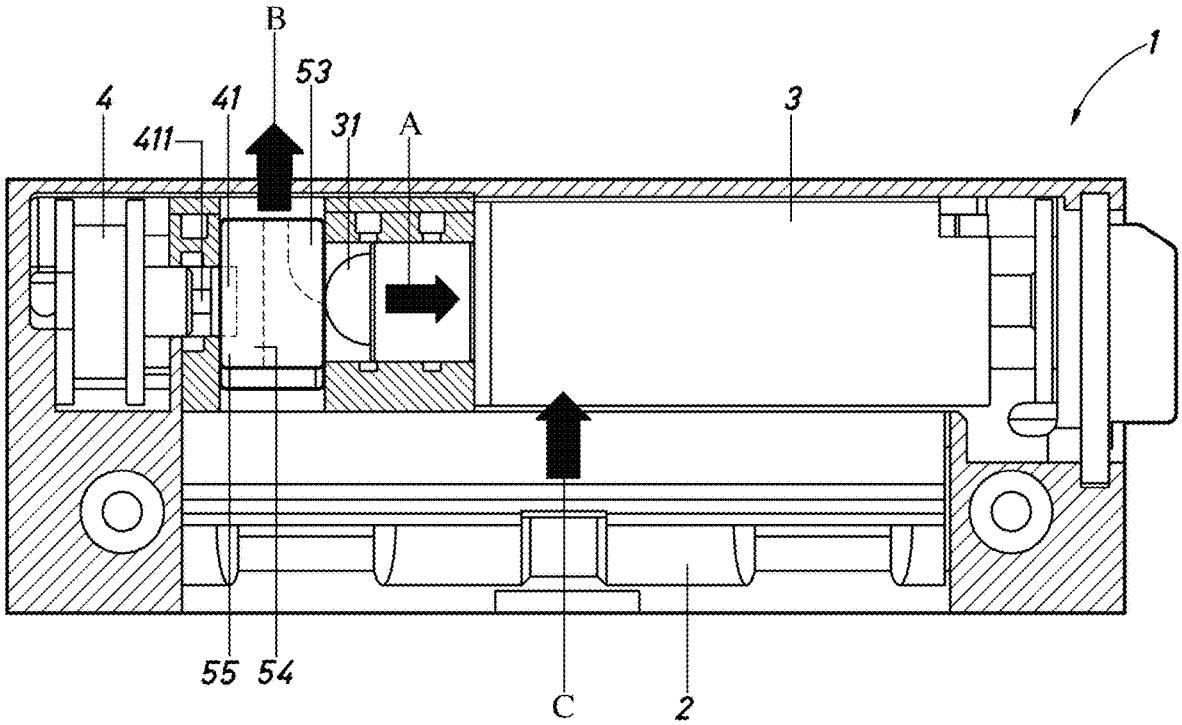
FIG. 9 shows the second embodiment electrically supplied, and therefore in the locked position, showing the locking which prevents the device from opening.
Figure 10:
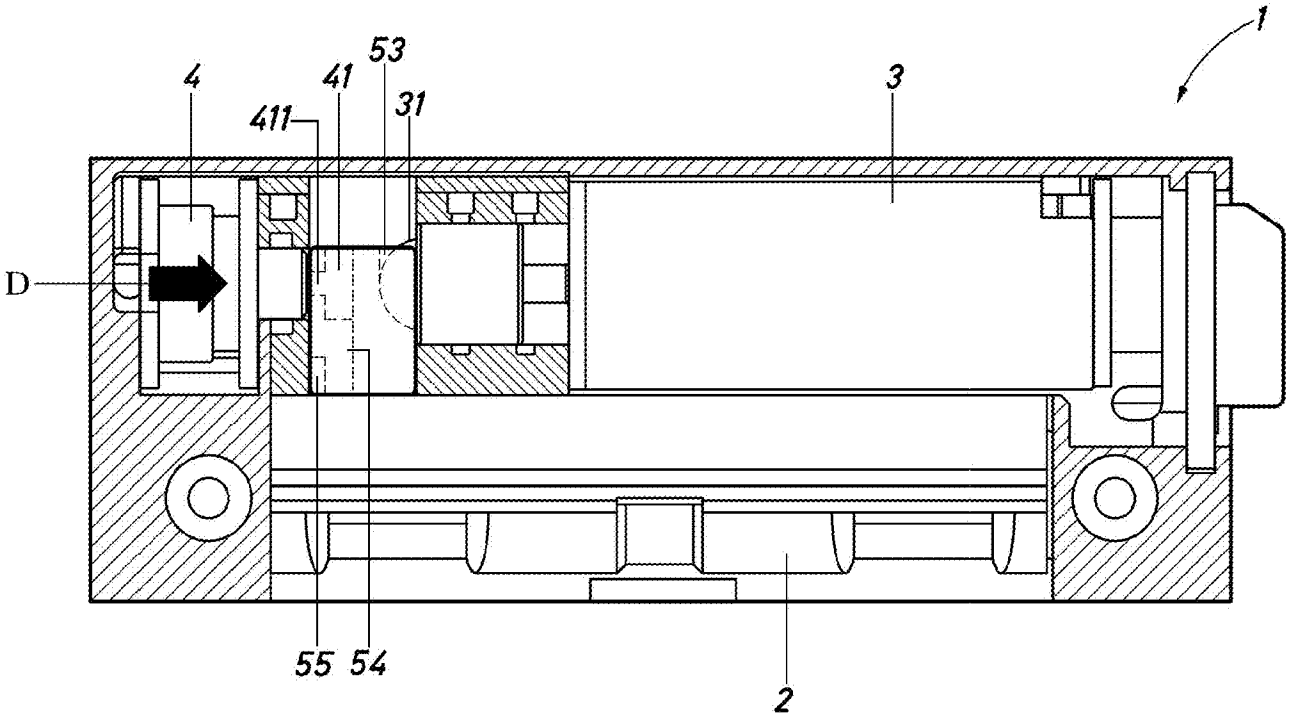
FIG. 10 shows a first phase of the process of unlocking the device of the second embodiment.
Figure 11:
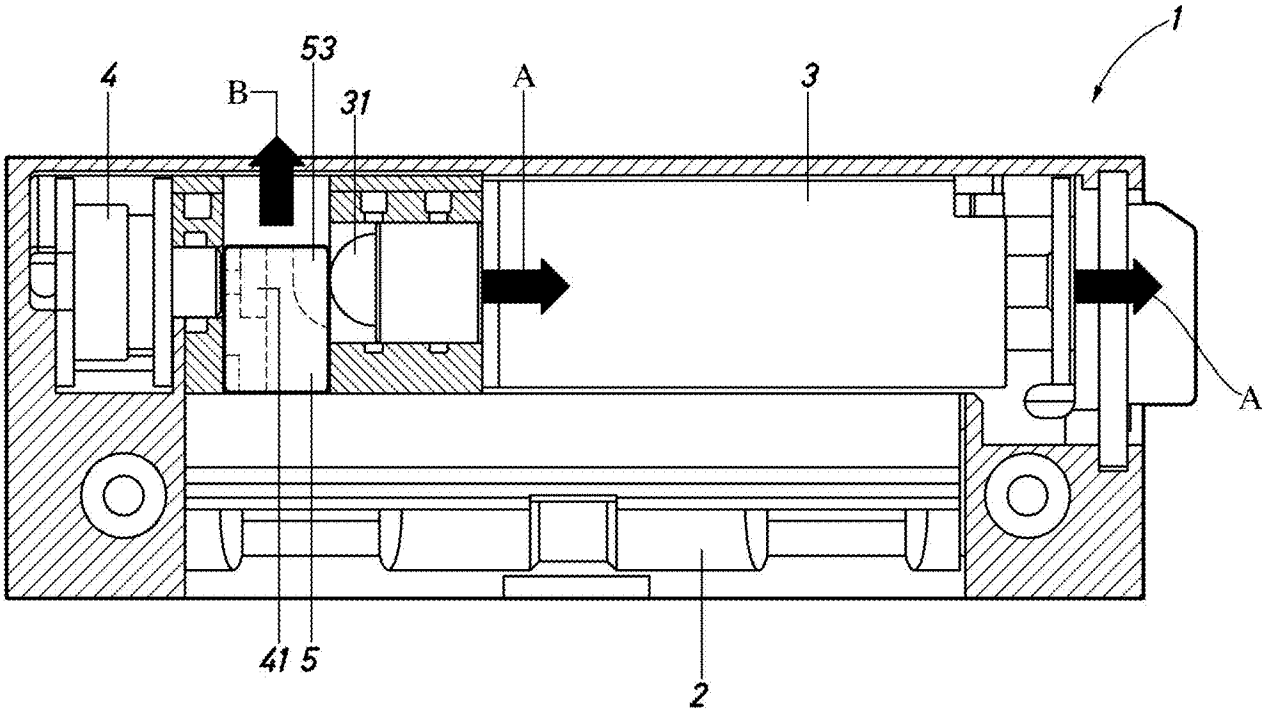
FIG. 11 shows a second phase of the process of unlocking the device of the second embodiment.

Under locking conditions, if an unauthorised access attempt occurs (indicated by the arrow -C-) which acts on the part -5-, indicated as force -B-, the preload system would act first. If this force overcomes the resisting force, said system would cause a retraction -A- of the preload system, and the locking system would come into play, which would guarantee the integrity of the system against the access attempt (FIG. 9).

A difference between the embodiment of FIGS. 7 to 12 and that of FIGS. 2 to 6 is the shape of the locking part -41- and the housing receptacle thereof -54-. In particular, the locking part -41- has a neck -411- having dimensions smaller than those of the free end or head thereof. Furthermore, the dimensions of the housing receptacle -54- are greater to allow movement of the central part -5- with the locking part inserted. Moreover, the housing receptacle has its own limit stop -55- for the locking part. Owing to the dimensions and shapes thereof, the locking part must be retracted for the head thereof to make contact with the limit stop -55-, thus locking the movement of the central part.

Consequently, a difference between this embodiment and the previous one is that the locking part -41- locks the central part -5- when retracted, whereas in the previous example, the retraction of the locking part -41- triggered the release of the system. However, variations of this and the previous embodiment in which this difference does not exist are also possible.

In the example shown, the right-hand coil -3- works on the retention system with preloaded opening (a person leaning on the door, wind, pressure seals, etc.). The system is based on a mechanism which reduces the force of the bolt. In this version, said mechanism comprises a steel ball -31-. When the central part -5- applies pressure to the ball -31-, because of its shape and shape, the ball tends to move freeing the movement of the central part -5-. If the coil -3- is deactivated, the steel ball -31- is able to move.

The left-hand coil -4- acts on a locking part -41- which locks the system when supplied with electricity, moves said locking part thus freeing the central part and hence the system.

Next the operation of the system when an unauthorised access attempt occurs will be described in relation to FIG. 9.

In said situation, the door is closed and is electrically supplied. If there is an unauthorised access attempt, the person who is trying to enter applies force or pressure. The unauthorised action -B- on the system may succeed in overcoming the retention force of the ball -31- and the retention force of the coil which holds the ball -31- in that position. In this case, the ball moves -A- freeing the central part -5-. At this moment the second coil -4- comes into play. Since the coil -4- continues being electrically supplied, the locking part -41- remains in the locked position, the movement of the central part -5- is still impeded and therefore the movement of the bolt -2-, which keeps the door closed, is locked.

Figure 12:
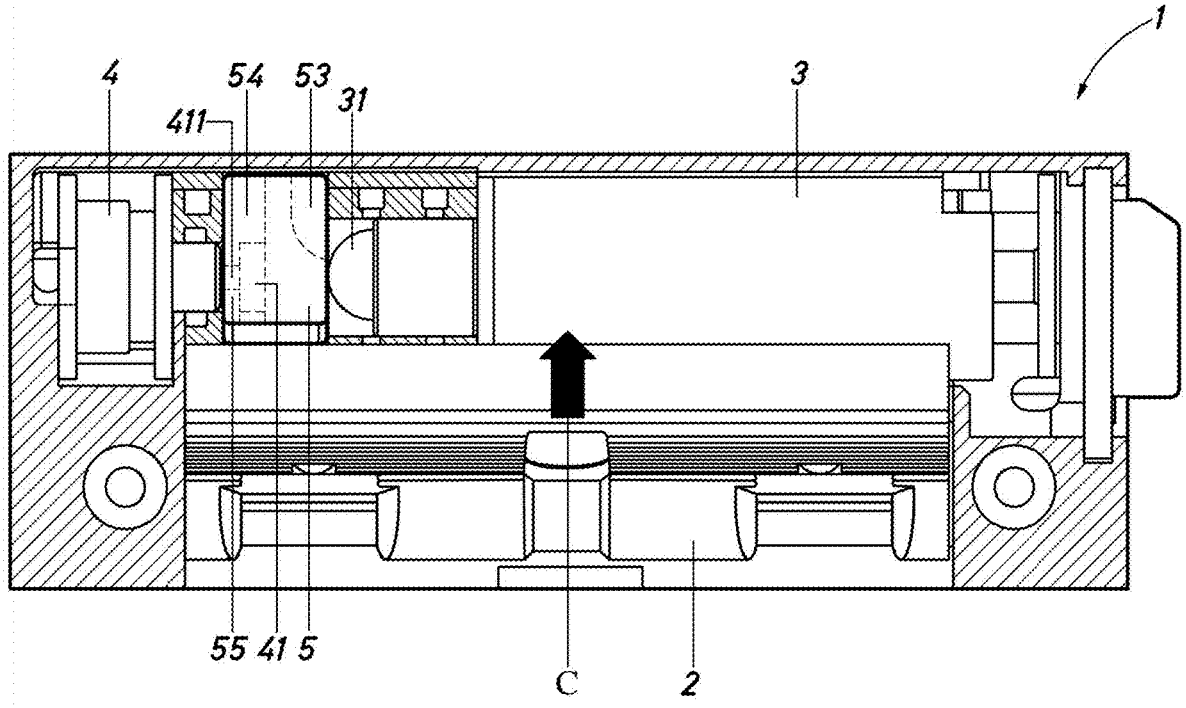
FIG. 12 shows a third phase of the process of unlocking the device of the second embodiment.

If, on the contrary, an authorised user wishes to open the door, the authorised opening system itself cuts the electricity supply. Using suitable components, for example an internal or external control system, the system deactivates the left-hand coil -4- first, which frees the locking part -41-, which, by the action of its return spring (not shown in the figures), is inserted farther into the housing receptacle -54- in the central part -5- and arrives at its unlocked position (see FIG. 10). Next, the coil -3- of the preloaded portion is actuated, freeing the ball -31-, which can leave its housing receptacle -53- in the central part -5- once the central part -5- begins to move (see FIG. 11). As can be seen in FIG. 12, this arrangement allows the central part -5- to move and hence permits the rotation of the bolt -2-.

Figure 13:
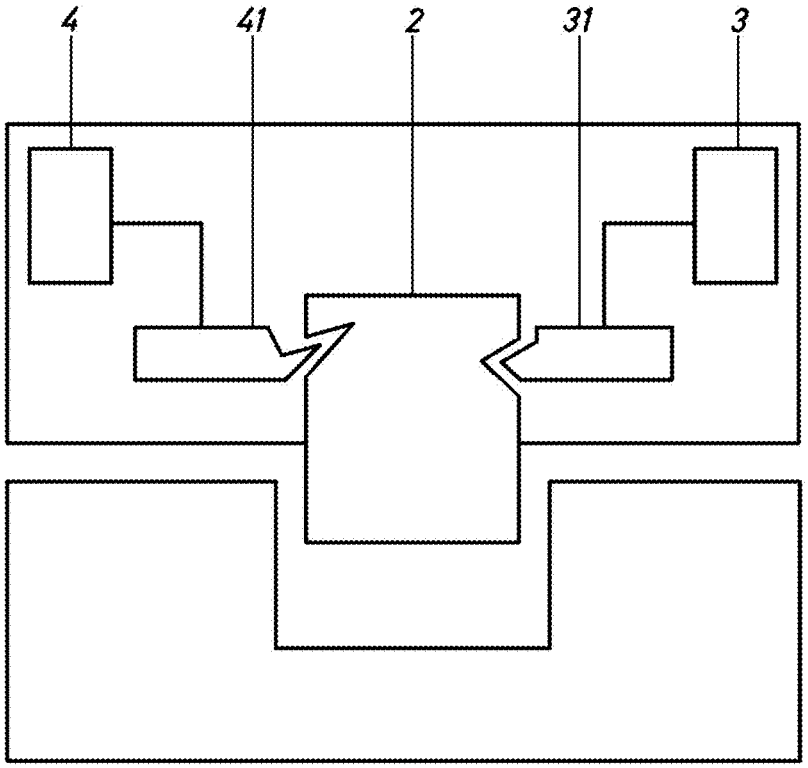
FIG. 13 is a diagram of a third embodiment similar to those shown in FIGS. 2 to 11.
Figure 14:
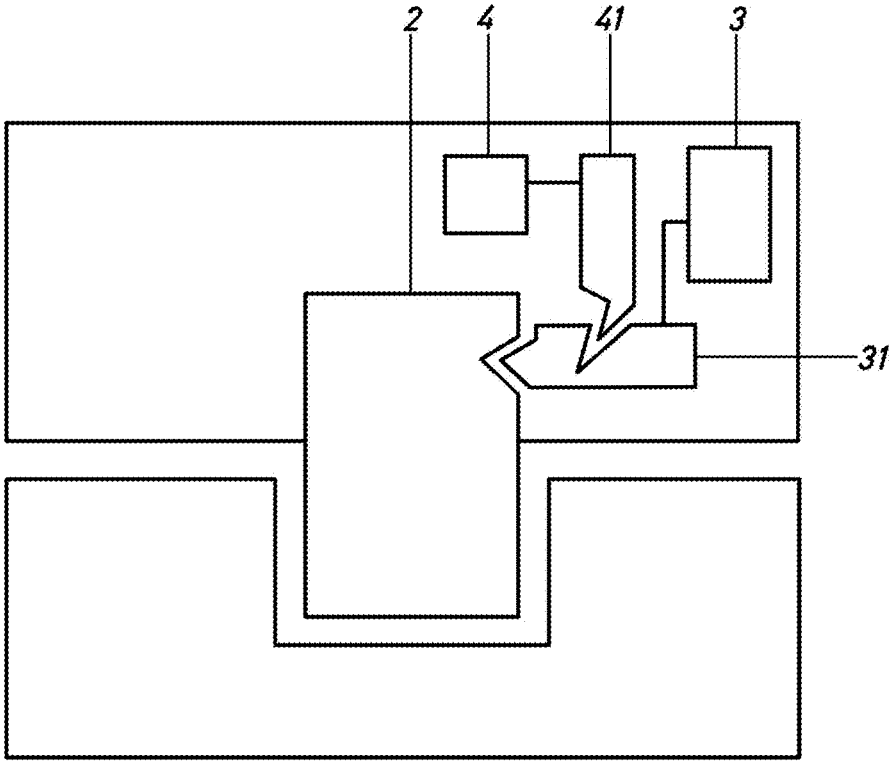
FIG. 14 is a diagram of a fourth embodiment.

FIGS. 13 and 14 are schematic views of two more embodiments of the present invention. In said figures, elements that are the same or equivalent have been identified with identical reference numerals to those given so far. Said elements will therefore not necessarily be explained in detail.

The embodiment in FIG. 13 is similar to those in FIGS. 2 to 11. In said figure, a bolt -2- or through-pin has been shown which locks two leaf elements (for example, a door or a window and the corresponding frame). The actuators -3- y -4- in this case act directly on the bolt or through-pin. The first actuator -3- has an element -31- which produces 'preload' retention (in other words, which can be opened on applying pressure). The second actuator -4- has an element -41- having an end which produces interlocking with secure locking.

The embodiment of FIG. 14 shows a typology based on that of conventional door openers and can therefore be applied thereto. In this case, the bar -31- of the first actuator -3- acts as a preloaded opening element, whereas the element -41- of the second actuator interlocks the bar -31- of the first actuator -3- thus performing the locking function. Unlike conventional door openers, the embodiment in FIG. 13 not only has a system for locking/unlocking the short bar, but also an additional system for locking/unlocking the preloaded opening element. Both coils can be actuated selectively and independently of one another. Unlike what occurs in conventional door openers, actuating the second actuator -4- does not necessarily imply a change in the activated or deactivated state of the preloaded opening element. The embodiment of FIGS. 13 and 14 may be implemented in ways other than those shown in the figure. For example, said embodiment may be implemented in a casing or box, as is standard for electromagnetic door openers or automatic entry phone systems.

Figure 15:
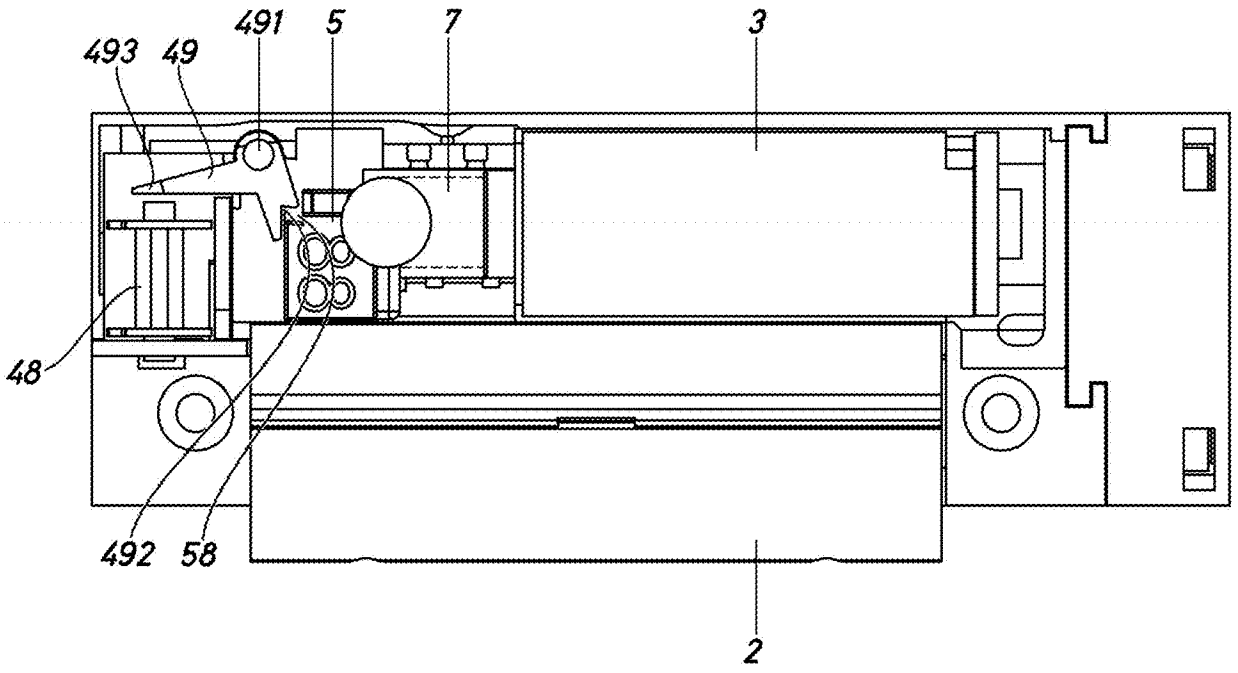
FIG. 15 shows a fifth embodiment of the present invention in the closed position.
Figure 16:
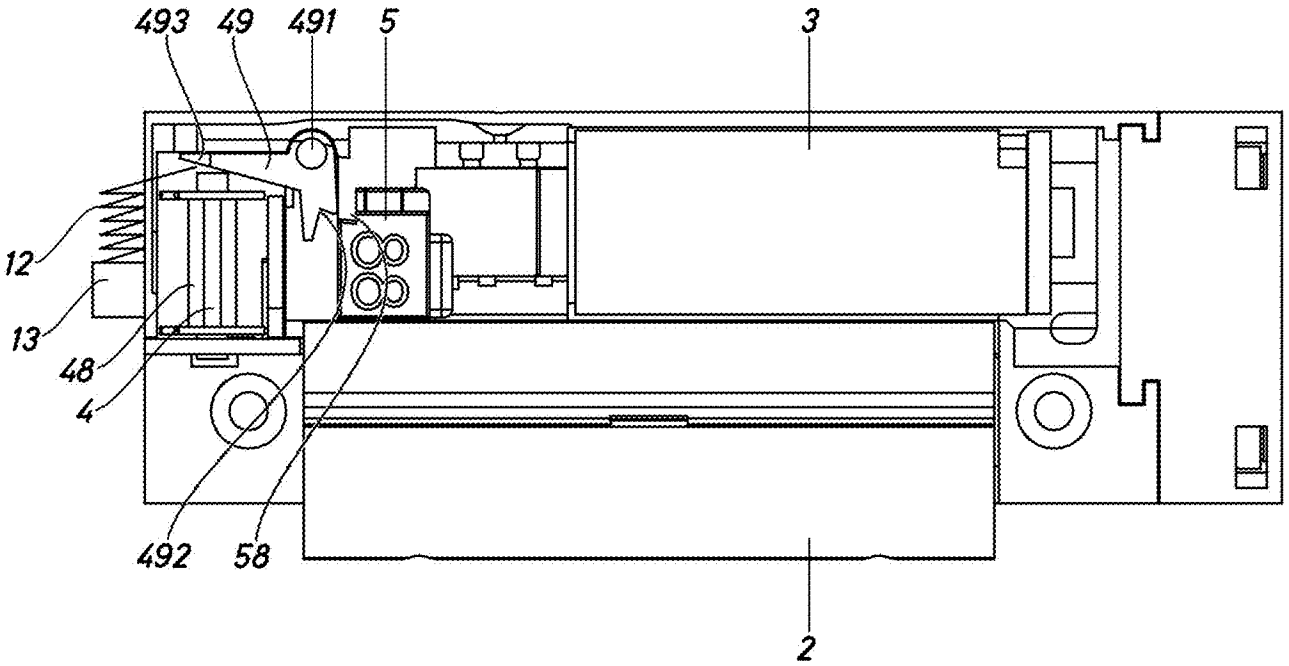
FIG. 16 shows a fifth embodiment of the present invention, with the second actuator in the unlocked position.

FIGS. 15 and 16 show an additional embodiment of a door opener having two actuators. Elements that are the same as or similar to those described above have been identified with identical reference numerals and will therefore not be described in greater detail.

The embodiment of FIGS. 15 and 16 differs from the embodiments of FIGS. 2 to 12 mainly in the construction of the second actuator. In particular, the first actuator has a tube -7- (see FIG. 15) which receives the ball so that the operation thereof is more fluid. The second actuator -4- of the example in FIGS. 15 and 16 comprises a coil having a different arrangement. In particular the arm -48- of the second coil extends in parallel with the movement of the central part -5- and actuates a rocker element -49- which rotates about a shaft -491-. When the coil -48- is actuated, this attracts the face -493- of the part -49- causing said part to rotate until a contact end -492- of the rocker element is positioned in the opening travel path of the central part -5-, preventing the complete opening of the door opener, even if the opening action overcomes the retention force generated by the first actuator -3-. In the closed position, there is a space or clearance between the central part -5- and the contact end -492- of the rocker element.

In contrast, with the coil -48- deactivated, said coil moves an end -493- of the rocker element -49- by means of a spring, which may be implemented as described in FIG. 16 and which causes the rotation of said element and withdraws the contact end -492- from the opening travel path of the central part -5-, allowing the door opener to open fully.

FIG. 16 also shows a system for adjusting the force applied by the rocker element -49-, a spring -12- and a manual or automatic system -13- for adjusting the spring in order to adjust the working voltage together with the coil -4-.

Figure 17:
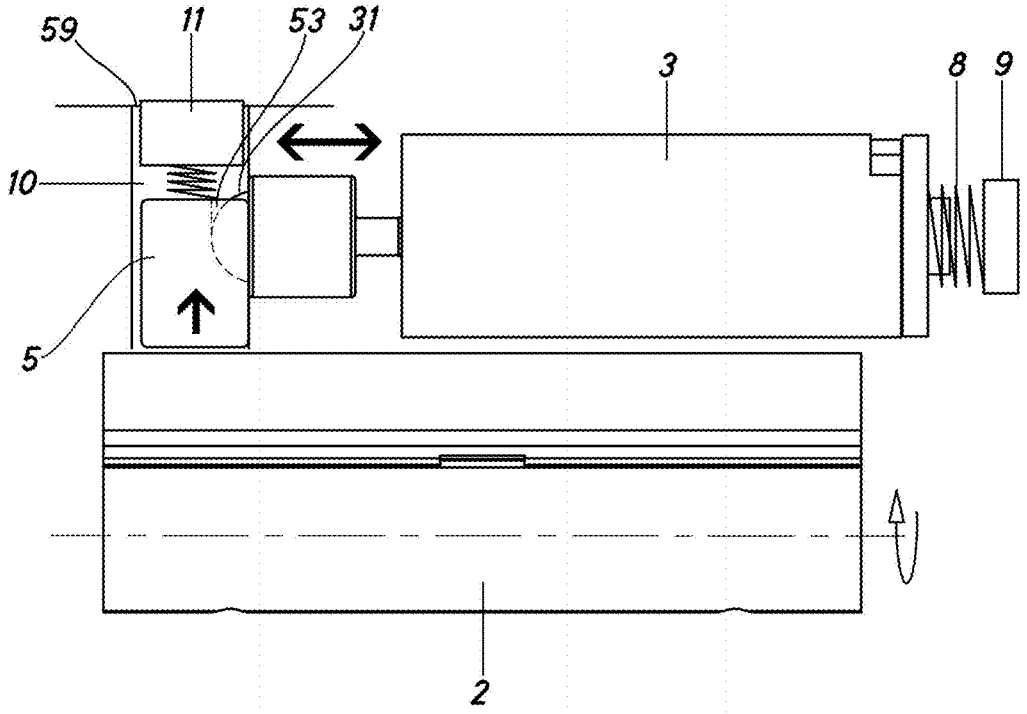
FIG. 17 is a schematic view of a sixth embodiment.

FIG. 17 shows an additional embodiment having a single actuator -3-, -31- similar to that of the embodiments of FIGS. 2 to 12 and 15 and 16. The central part -5- is also similar. As can be seen, the closure assembly also comprises, in this case, a bolt -2-, which may be rotary, and a through-pin having a travel path that may be linear. Said bolt -2- pushes a central part -5-, which slides along a channel -59-. The central part has a recess in which the end -31- of the actuator acts, said actuator in this case being spherical, for example. Consequently, the end performs a retention action in such a way that the device can be opened if an action which overcomes the action applied by the actuator -3- (in this particular case, by the coil thereof) is applied across the slider. If the actuator or coil -3- is capable of applying a sufficiently strong force, the functions of opening under preload and of retention may be obtained simply by varying the force applied by the actuator (the coil -3-).

This embodiment shows how the use of a central part -5- in the form of a slider having a linear travel path along a channel -59- helps save space compared with embodiments which have a long bar structure. It is therefore possible to use a single actuator in a small-size device, while minimising the wear problems mentioned in the introduction.

The device according to the present invention may, as in the example, have a spring or resilient element -8- in the rear portion of the coil -3- which acts directly with regard to the retention force of the ball and therefore increases the load required to open the mechanism. More preferably, said device also has an automatic or manual system for adjusting the pressure of said spring -9-, said system allowing the user to adjust the load required to open the mechanism whether the coil -3- is actuated or not.

More preferably, said device may have a similar system for the part -5-, possibly consisting of a resilient element -10- and a manual or automatic adjustment system to directly adjust the opening load on the part -2-.

A system for automatically adjusting the force applied by the different elements of the device may be connected to external control means which vary the properties of the mechanisms depending on external factors, such as variations in wind, a variation in the load required for opening, on whether or not the user is authorised, the hours during which the probability of burglaries is greater, when there is a higher probability of avalanches, etc.

The system may be implemented in conventionally operated mechanisms since said system can be implemented for all the springs that may be present in said system, such as those of the bolt, long bar, short bar or coil.

Figure 18:
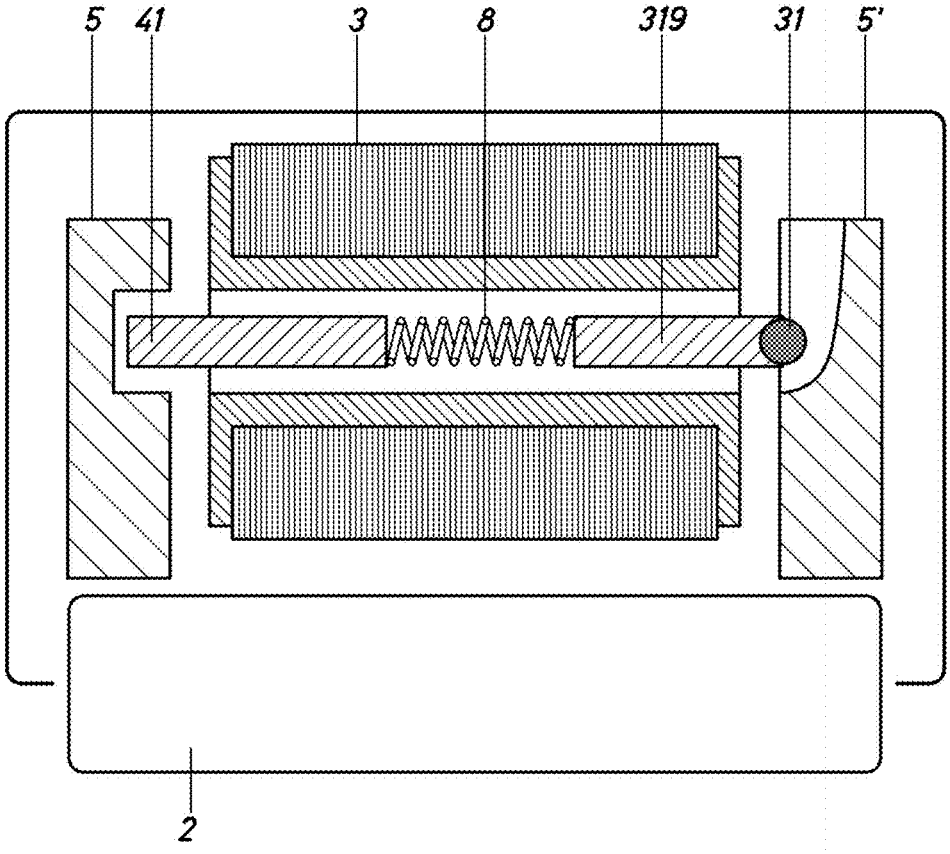
FIG. 18 is a schematic view of a seventh embodiment.

FIG. 18 shows an additional embodiment. Elements that are the same, similar or equivalent have been shown with identical reference numerals. In this embodiment, the device pushed by the closure assembly or bolt -2- is composed, in a non-limiting way, of two separate parts -5-, -5'-.

The embodiment also has a resilient element -8- which helps generate a force that takes both the locking part -41- and the ball -31- to their respective housing receptacles, each situated in one of the sliding parts -5-, -5'- pushed by the bolt -2-. The embodiment has a single coil which actuates the locking part.

This embodiment is economical. Owing to the opposed arrangement with regard to the action of the ball -31- and the locking part, it is resistant to vibrations. Two separate actions are illustrated in the embodiment shown. In this embodiment, it is also possible to implement the device such that the coil -3- actuates the ball -31- via the connection part -319-.

Figure 19:
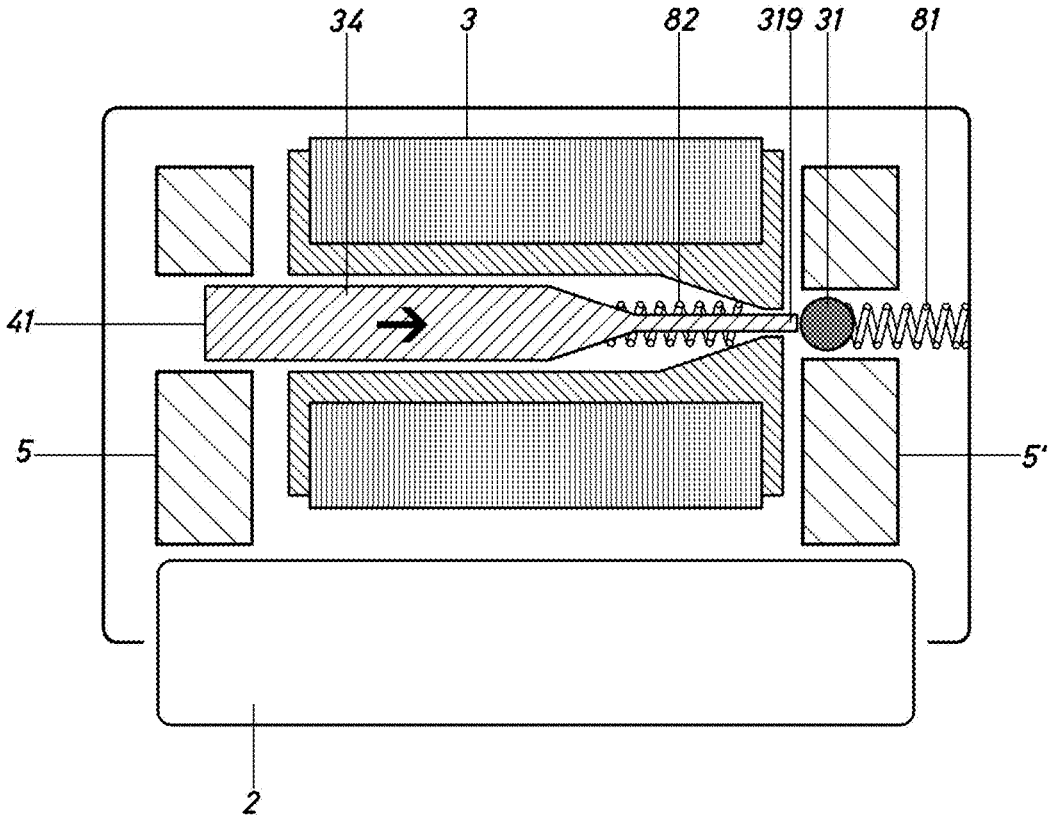
FIG. 19 is a schematic view of an eighth embodiment.

FIG. 19 shows another additional embodiment. Elements that are the same, similar or equivalent to those shown in other figures have been identified with identical reference numerals. This embodiment, like the previous ones, has a single actuation coil -3- which performs the functions of unlocking and removing the ball from its position. When the coil -3- actuates the part -34- in the direction marked, the end -319- of the part -34- pushes the ball -31- counter to the action of the spring -81- and extracts said ball -31- from its position. Before the ball -31- is extracted, the locking end -41- has come out of the locking zone of the slider -5- and the action is therefore sequential (the interlocking is removed first, followed by the retention caused by the ball -31-). In addition, the device pushed by the bolt -2- comprises two sliding parts -5-, -5'-.

As indicated above, the embodiments of FIGS. 17 to 19 can be implemented having a single coil or equivalent actuator, but with separation of the locking/interlocking function and the retention/preload function. This is facilitated by the presence of at least two sliding parts, one for each of said functions.

Although the invention has been presented and described with reference to embodiments thereof, it should be understood that said embodiments do not limit the invention and therefore it is possible to vary many structural or other details which will be clear to persons skilled in the art after interpreting the subject matter disclosed in the present description, claims and drawings. Thus, the scope of the present invention shall cover all variants and equivalents that can be considered to be included within the most extensive scope of the following claims.

Numerals within parentheses in the accompanying claims are placed there to facilitate understanding of the invention. They do not form part of the claim and should not be seen as interpretative and/or limiting indications of the scope of claim and the meaning of their related terms.

What is claimed is:

1. A locking device comprising:

a closure that can move between an open position and a closed position, and a lock configured to lock said closure in the closed position, wherein:

the lock comprises a first actuator and a second actuator, the first actuator and the second actuator have a locked position, in which a locking or retention action is applied, and an unlocked position, the first and the second actuators have respective control devices which allow orders to be given to change the position of each respective actuator, the first actuator and the second actuator are arranged in such a way that unlocking the lock requires that both control devices place their respective actuator in the unlocked position, and when both actuator assemblies are in the locked position, a movement to open the closure causes the locking or retention action of each actuator to be applied sequentially.

2. The locking device according to claim 1, wherein both the first actuator and the second actuator are positioned in such a way that they apply their locking action directly on the closure or on a device that is actuated by the closure.

3. The locking device according to claim 2, wherein the first actuator and the second actuator apply their locking action at different points of the closure or of the device which is actuated by the closure.

4. The locking device according to claim 3, wherein the device actuated by the closure support comprises two or more sliding parts actuated by the closure, one of said parts receiving the action of the first actuator and the other the action of the second actuator.

5. The locking according to claim 1, wherein the second actuator applies its locking action directly on the first actuator.

6. The locking according to claim 1, wherein in the locked position, the first actuator applies a predetermined retention force which, on being overcome by an external action applied via the closure, allows the closure to move.

7. The locking according to claim 5, wherein the second actuator has a play between the closure which defines limits to said movement of the closure, when the second actuator is positioned in the locked position.

8. The locking device according to claim 6, wherein play between the second actuator and the closure defines limits to said movement of the closure, when the second actuator is positioned in a locked position.

* * * * *